United States Patent [19]

Malucci et al.

[11] 4,212,511

[45] Jul. 15, 1980

[54] ELECTRICAL CONNECTIONS FOR CONDUCTORS IN THIN SUBSTRATES

[75] Inventors: Robert D. Malucci, Dauphin; Charles E. Reynolds, Mechanicsburg, both of Pa.

[73] Assignee: AMP Incorporated, Harrisburg, Pa.

[21] Appl. No.: 960,425

[22] Filed: Nov. 13, 1978

[51] Int. Cl.[2] ..... H01R 11/08

[52] U.S. Cl. ..... 339/276 T

[58] Field of Search ..... 339/17 F, 17 LC, 97 C, 339/176 MF, 276 R, 276 C, 276 SF, 276 T

[56] References Cited

U.S. PATENT DOCUMENTS

| | | | |
|---|---|---|---|
| 2,945,083 | 7/1960 | Ganske et al. | 339/276 |
| 3,124,641 | 3/1964 | Anderson | 339/276 |
| 3,388,369 | 6/1968 | Zalmans | 339/276 T |
| 3,461,221 | 8/1969 | Herb | 339/276 |
| 3,496,520 | 2/1970 | Reynolds | 339/276 T |
| 3,715,705 | 2/1973 | Kuo | 339/98 |
| 3,728,665 | 4/1973 | Frey | 339/97 C |
| 3,852,702 | 12/1974 | Dowling | 339/276 T |
| 3,864,008 | 2/1975 | Bakermans et al. | 339/276 SF |
| 3,880,488 | 4/1975 | Collier et al. | 339/97 C |
| 3,891,293 | 6/1975 | Jones | 339/97 C |

*Primary Examiner*—Joseph H. McGlynn
*Attorney, Agent, or Firm*—Frederick W. Raring

[57] ABSTRACT

A crimped electrical connection between a stamped and formed metallic connecting device and a conductor on an insulating film comprises a pair of opposed cantilever beams connected by an arcuate bight with the film being between the beams. The beams are in a flexed condition against the film and are therefore maintained against, and in electrical contact with, the conductor on the film. The crimped connection can be used under a wide variety of circumstances.

7 Claims, 17 Drawing Figures

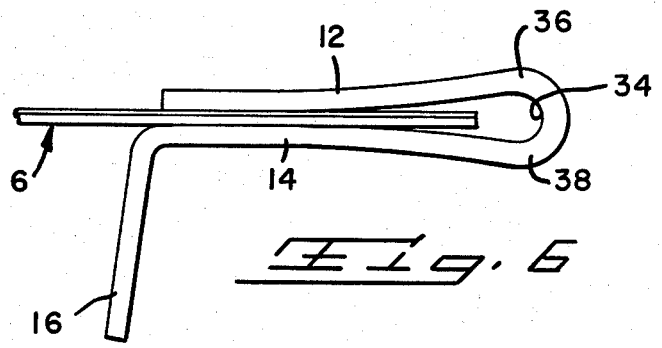
Fig. 6
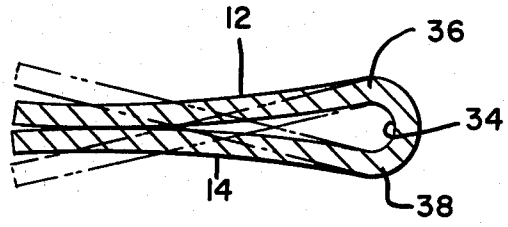
Fig. 7
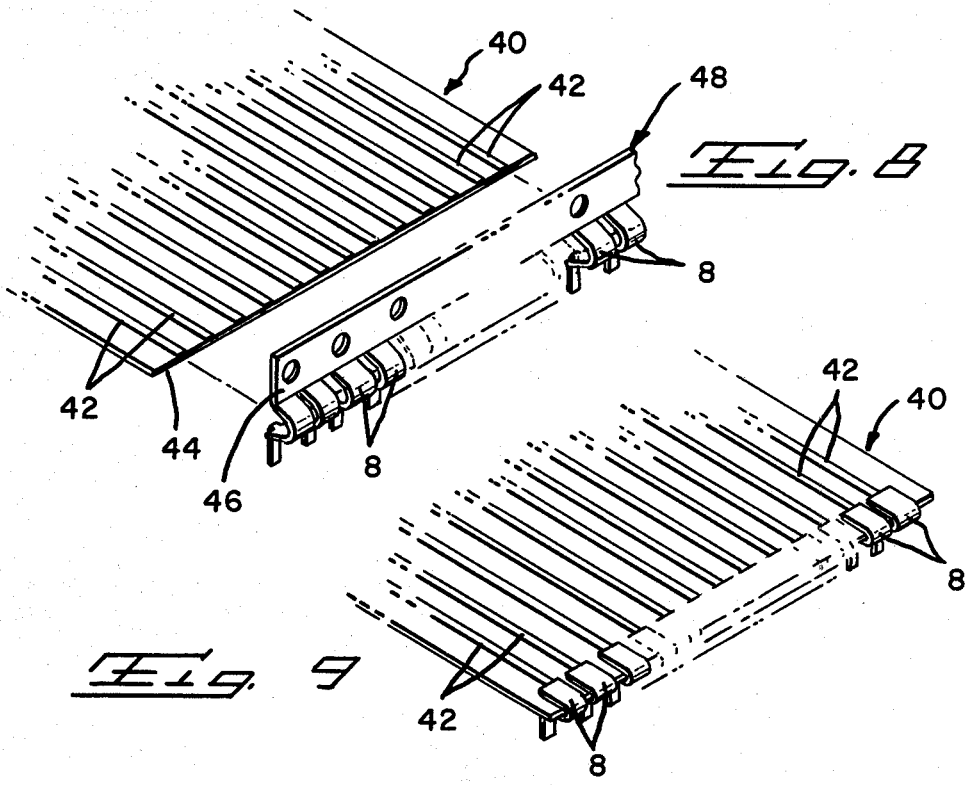
Fig. 8
Fig. 9

THE CHANGE IN SLOPE (ΔS) AT THE END OF THE BEAM IS GIVEN BY $$\Delta S = \tan\theta = \frac{F_2 L^2}{2EI}\sqrt{1+\left(\frac{H}{2L}\right)^2}$$

WHERE $$\tan\theta = \frac{\dfrac{(1-X)}{\sqrt{2X-X^2}} - \dfrac{(1-X_0)}{\sqrt{2X_0-X_0^2}}}{\left(1+\dfrac{(1-X)}{\sqrt{2X-X2}}\,\dfrac{(1-X_0)}{\sqrt{2X_0-X_0^2}}\right)}$$

ELECTRICAL CONNECTIONS FOR CONDUCTORS IN THIN SUBSTRATES

TECHNICAL FIELD OF THE INVENTION

This invention relates to crimped electrical connections for conductors on substrates, such as insulating films. The invention can be used under a variety of circumstances where electrical connections must be made to conductors on a substrate.

BACKGROUND OF THE INVENTION

Widespread use is made in the electrical and electronics industries of substrates having conductors on one or both of their surfaces. The substrates may comprise relatively thin films, such as Mylar (polyester) or Kapton (polyimide). The conductors are provided on the surfaces of the films by several different methods. Silkscreening is widely used as a low cost method of producing extremely thin conductors on the surfaces of the films. Silkscreened conductors are extremely delicate, or fragile, and are subject to damage when electrical connections are made to such conductors. Conductors are also provided on surfaces of films by electrodeposition in selected areas and along desired conductive paths, or by depositing conductive metal over the entire surface of a film and selectively etching the surface to leave the desired conducting paths. These electrodeposited conductors are somewhat more durable than silkscreened conductors but are still relatively fragile. It is also known to laminate thin sheets of conductive metal to a film and etch away the surface of the film to leave the desired conductors. These laminated wrought metal conductors are relatively durable and relatively thick, but they are also relatively costly to produce.

Electrical connections can be made to conductors on insulating films by soldering methods, but these are usually highly labor intensive and therefore costly. Furthermore, care must be taken in making soldered connections to silkscreened and electrodeposited conductors that the conductors on the film will not be damaged by the heating of the soldering operation. Several crimp-type connecting devices can be used on laminated film having wrought conductors thereon, see for example U.S. Pat. No. 3,395,381. However, while wrought conductors on film will withstand the relatively high compressive forces required during the crimping operation, the more delicate electrodeposited and silkscreened conductors are liable to be damaged by these compressive forces during the crimping operation.

The present invention is directed to the achievement of a crimped electrical connection which can be used with all types of conductors on films; wrought laminated conductors, silkscreened conductors, and electrodeposited conductors. The invention is further directed to the achievement of a crimping method which does not cause damage to relatively fragile conductors.

A crimped electrical connection in accordance with the invention is produced by initially forming a strip of conductive metal into a "U" and positioning the film between the arms of the "U" with the conductor on the film in alignment with one of the arms. The U-shaped connecting device is then located between the opposed parallel faces of crimping dies and the dies are moved towards each other in a direction extending normally of their opposed faces. As the dies are closed, the arms of the U-shaped connecting device, which function as cantilever beams, first move towards each other until their ends engage the surfaces of the film. The opposed surfaces of the dies are moved an additional distance towards each other and during such movement, they reduce the crimp height of the bight portion of the connecting device with accompanying plastic or permanent deformation of the bight portion. During movement of the dies for this additional distance, the arms of the cantilever beams are resiliently flexed against the surfaces of the film so that permanent electrical contact is established with the conductor on the film. A particularly significant feature of the invention is that during the final stages of crimping, the principal crimping forces are applied only to the bight portion and not to the cantilever beams. The conductors on the film are not therefore subjected to these high principal crimping forces, but they are subjected to much lower forces which are developed in the cantilever beams.

DESCRIPTION OF DRAWINGS

FIG. 6 is a side view of a crimped connection in accordance with the invention.

FIG. 7 is a diagrammatic side view illustrating the manner in which the connecting device is stressed in the crimped connection.

FIG. 8 is a perspective view of an end portion of the cable having conductors thereon and a section of a continuous strip of connecting devices in accordance with the invention.

FIG. 9 is a perspective view of the end portion of a cable having connecting devices crimped onto the conductors of the cable.

PRACTICE OF THE INVENTION

Figure 1:
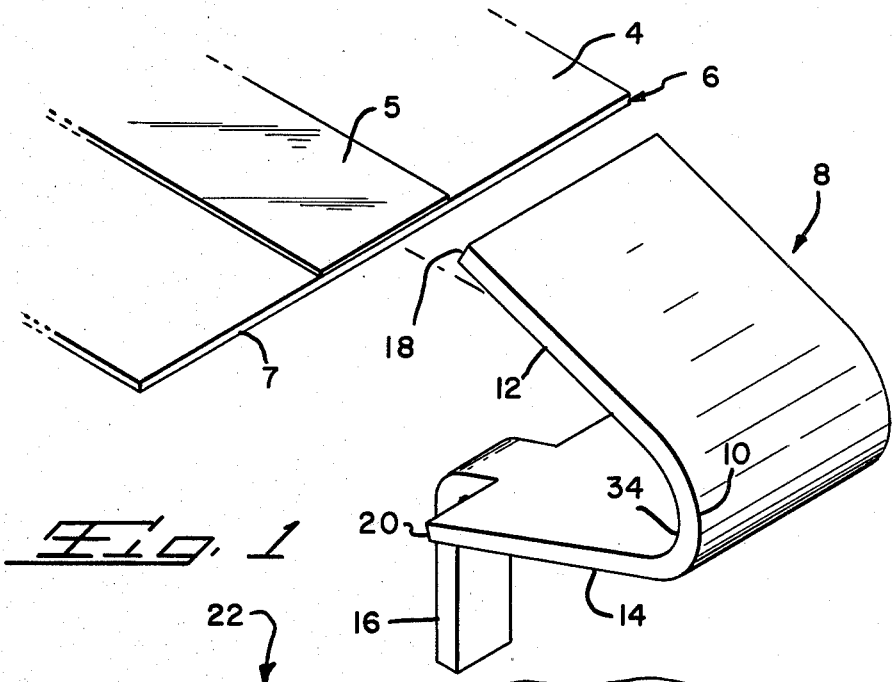
FIG. 1 is a perspective view of a portion of a film having a conductor on its surface and a connecting device in accordance with the invention.

FIG. 1 shows an uncrimped connecting device 8, in accordance with the invention, which is adapted to be crimped onto an insulating film 6 having a conductor 5 on its upper surface 4, the conductor extending to an edge 7 of the film. The film may be, for example, polyester or polyimide and the conductor may be of the silkscreen type, the electrodeposited type, or a wrought conductor. The connecting device may be of any suitable conductive metal having the required spring properties, such as hardened brass. The connecting device 8 is generally U-shaped having an arcuate bight 10 and arms 12, 14 which are referred to as cantilever beams, since they function as beams in the crimped connection. An integral post 16 extends from the end 20 of the arm 14 which may be connected to a further conductor, or which may be mated with a complementary connecting device.

The connecting device 8 is crimped onto the film 6 by crimping dies 22, 22' which are mirror images of each other. Accordingly, the structural features of the two dies are identified by the same reference numerals differentiated by prime marks.

The upper die 22 has a vertically extending front surface 24, a horizontally extending crimping surface 26, and a stop surface 30 which is separated from the crimping surface 26 by a vertically extending shoulder 28. The shoulder 28 is recessed from the surface 24 by a distance such that this shoulder and the shoulder 28' do not engage the bight portion 10 of the connecting device during crimping.

Figure 2:
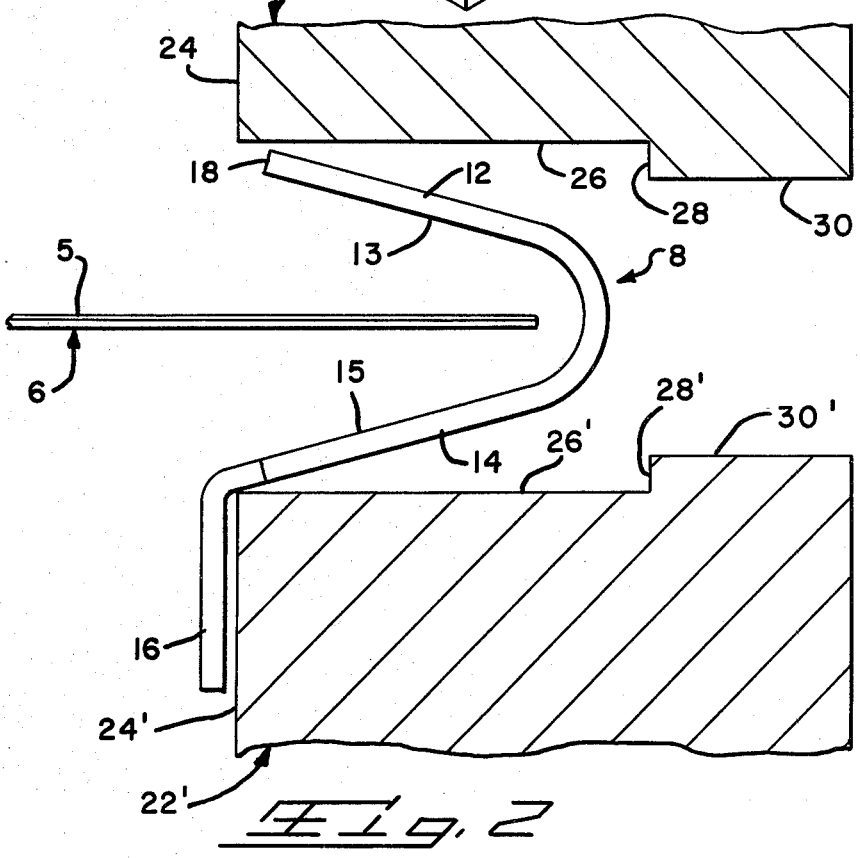
FIG. 2 is a cross-sectional view of a pair of crimping dies for crimping the connecting device onto the film, this view showing the dies in their opening position which they occupy at the beginning of the crimping process.

To crimp the connecting device 8 onto the film, the connecting device is positioned as shown in FIG. 2 with the ends 18, 20 of the cantilever beams 12, 14 adjacent to the surfaces 24, 24' and against the surfaces 26, 26'. The film is positioned between the opposed surfaces 13, 15 of the cantilever beams 12, 14 with the edge 7 adjacent to the center or root 34 of the bight 10. The dies 22, 22' are then moved along straight line paths toward each other until the stop surfaces 30, 30' are against each other. These stop surfaces thus determine the final crimp height (the distance between the surfaces 26, 26') in the crimped connection.

Figure 3:
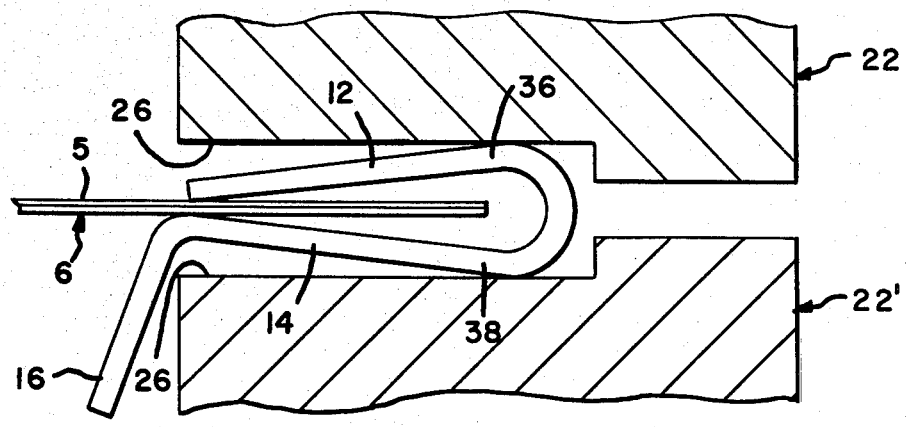
FIGS. 3 and 4 are views similar to FIG. 2, showing the positions of the dies at successive stages of the crimping operation.

During crimping, the ends of the arms 12, 14 are moved towards each other until they are against the surfaces of the film, as shown in FIG. 3. During this initial portion of the crimping process, the zone of contact, or engagement, of the surfaces 26, 26' with the external surfaces of the arms 14, 12 moves relatively rightwardly, as viewed in FIGS. 2 and 3 and at the intermediate stage of FIG. 3, the surfaces 26, 26' will be against the connecting device 8 at diametrically opposite locations on the bight 10. It will be noted in FIG. 3, that the radius of curvature R of the bight portion is substantially unchanged from the original radius.

Figure 4:
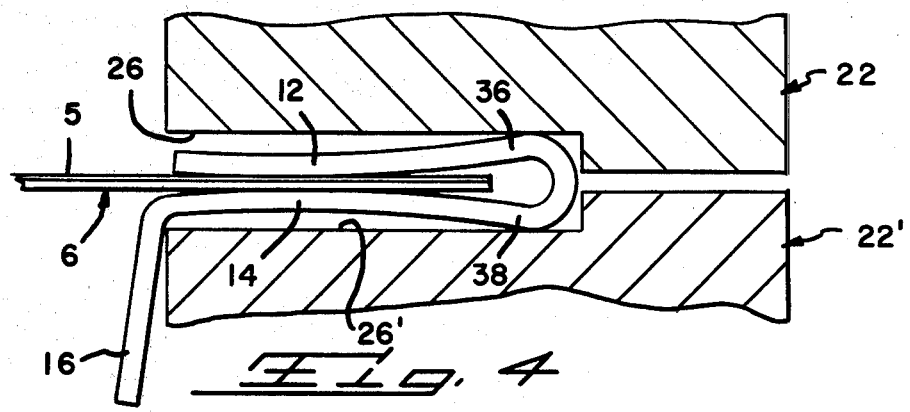
Figure 5:
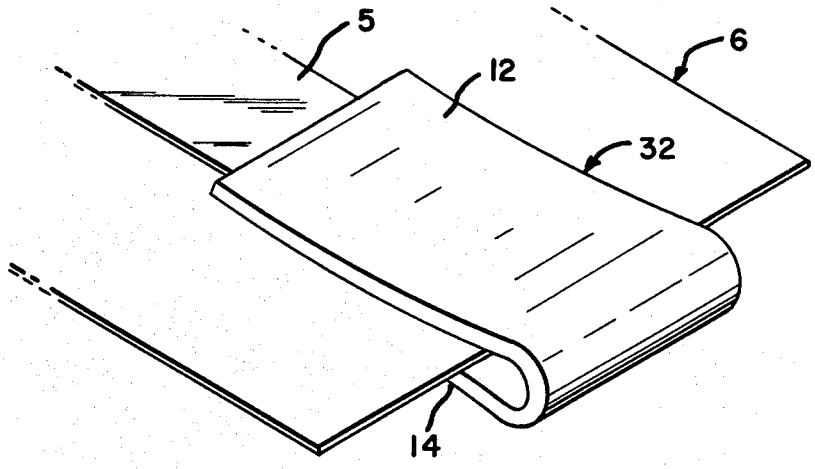
FIG. 5 is a perspective view of a crimped connection in accordance with the invention.

During the final stage of the crimping process, and as the dies move to their fully closed condition of FIG. 4, the material in the root 34 (FIG. 6) of the bight portion is plastically deformed and the radius of curvature in the root portion 34 is substantially reduced although the radius of curvature in zones 36, 38, adjacent to the root 34, will be substantially unchanged from the original radius R. During this stage, the cantilever beams 12, 14 are resiliently stressed against the surfaces of the film and after the dies are opened and the crimped connection removed from the dies, these beams will be held in their stressed condition by the plastically deformed root 34 of the bight 10. FIG. 7 illustrates the manner in which the cantilever beams 12, 14 are stressed in the completed crimped connection. The solid lines in this figure show the actual positions of the beams 12, 14 and the dotted lines show the positions that these beams would assume if they were unrestrained by each other. The beams are thus resiliently urged against the surfaces of the film and the upper beam 12 is maintained in electrical contact with the conductor 5. The lower beam 14 would similarly be maintained with a conductor on the lower surface of the film.

Crimped connections, in accordance with the invention, can be made with films of varying thickness and the connecting devices can be in a wide range of sizes. For example, good results have been obtained with a connecting device formed of 0.012" thick brass having a radius of curvature in the bight of 0.02" and having arms or cantilever beams 0.08" long. This connecting device was used with a film having a thickness of about 0.010".

There are requirements which must be respected regarding the dimensions of the connecting device and the physical properties of the material of the connecting device in order to achieve successful practice of the invention. An operable and effective crimped connection, in accordance with the invention, will be achieved if the connecting device is designed and crimped in accordance with the general principles set forth in the following discussion.

The parallel spaced-apart surfaces 26, 26' in FIG. 2 of the crimping dies, should move towards each other along straight line paths which extend normally of the planes of these surfaces. If the die surfaces move in this manner, the zones of contact or engagement of the die surfaces 26, 26' with the beams 12, 14 will be as shown in FIG. 3 at an intermediate stage of the crimping process and further movement of the die surfaces toward each other will bring about the desired reduction of the radius portion 34 of the bight 10 and the development of the contact force in the cantilever beams 12, 14.

For a connecting device having a given geometry, a given initial bight radius R, and a beam length L, a material thickness t, and having given physical properties in the material, such as strength and elastic modulus, there is a crimp height which is reached in an intermediate stage of the crimping operation at which the ends 18, 20 of the cantilever beams 12, 14 will touch each other. This crimp height is shown at FIG. 3 and at this crimp height, there is no significant stress in the beams 12, 14. It is apparent that it must be possible to further crimp the connecting device to the crimp height shown in FIG. 4 so that the beams will be stressed and loaded against the film 4. This means that the material of the connecting device must be capable of undergoing a substantial amount of plastic deformation at the bight 34 while it is crimped from the position of FIG. 3 to the position of FIG. 4. If the material is incapable of undergoing this required amount of plastic deformation, it will fail in the bight 34 and the loading force in the beams will be relieved so that no contact pressure will be developed. Also, the initial radius of the bight R, FIG. 8, enters into these matters, in that if this initial R is too small, it may be impossible to reduce the crimp height by an amount which will result in the development of the desired flexure or bending stresses in the cantilever beams.

It is entirely practical to design specific connecting device, in accordance with the invention, by using empirical methods in accordance with the considerations discussed above. For example, a connecting device having the desired beam length L and a radius R, and of a given material and material thickness, can be designed and crimped as shown in FIGS. 2–4. If it is found that the material fractures in the bight area 34 when the final crimp height is reached, the connecting device can then be duplicated with a different material which will withstand greater strain after yielding than the original material. In other words, using a material having a lesser strength level than the original material, such as a material which was less violently cold worked during rolling than the original material. Specifically, if it is found that a relatively hard brass terminal fails in the bight area 34 upon crimping, a less hardened brass material can be substituted for the original material.

The substitution of material discussed above would result in a loss in the stress levels in the cantilever beams 12, 14 and the reduction in the stressing of the beams would result in a lower contact pressure on the film 6. If this reduction in the contact force is not acceptable, the beam length L, or other variables, can be changed when the material is changed. Alternatively, a superior material can be used instead of the original material which would be capable of withstanding the required amount of radius reduction in the bight area without fracture. For example, a phosphor bronze material might be substituted for a brass material.

While empirical methods based on the foregoing discussion can be used to design a connecting device in accordance with the invention, it is also possible to design a specific connecting device in accordance with the mathematical analysis of the crimped connection of the invention presented below. If this mathematical method is followed, the performance of the connecting device during crimping and the contact force which will be developed in the cantilever beams can be predicted.

This mathematical analysis is presented as a contribution intended to facilitate and clarify this disclosure of Applicants' crimped connection. Applicants do not intend to be bound strictly by this presentation inasmuch as it will undoubtedly be refined and/or extended as crimped connections in accordance with the invention are studied in greater depth.

Figure 10:
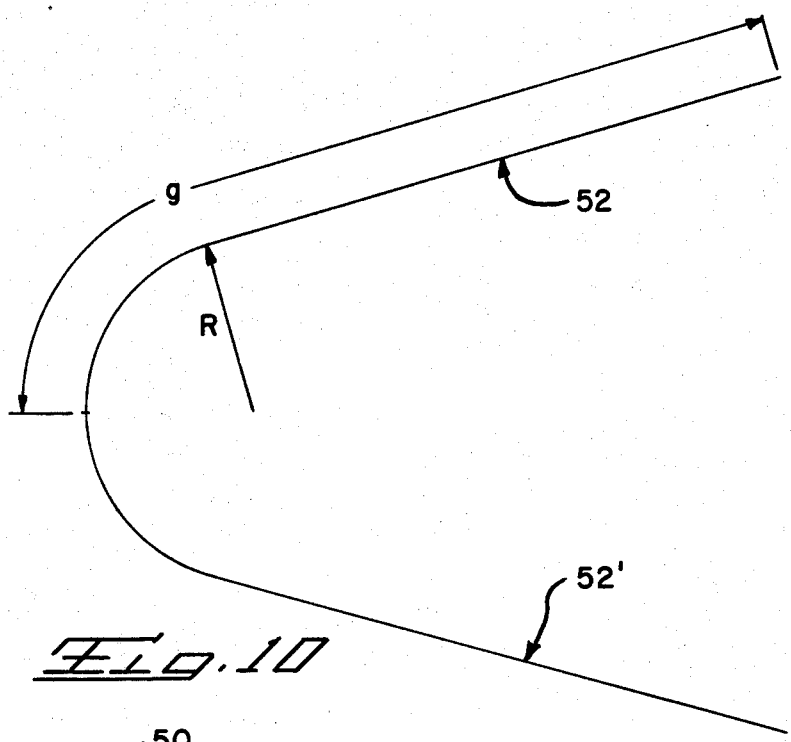
FIG. 10 is a side view of an idealized connecting device in accordance with the invention, which is referred to in a mathematical analysis presented below.

For purposes of this derivation, it is assumed that a connecting device, in accordance with the invention, has a semi-circular bight portion of radius R and a length g from the center of the bight to the end of each arm as shown in FIG. 10.

Figure 11:
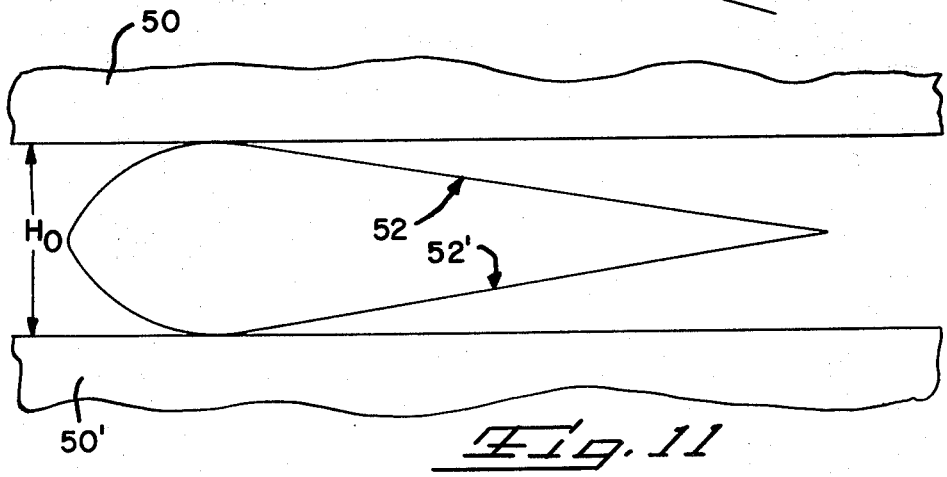
FIG. 11 is a view similar to FIG. 10, but showing the connecting device at an intermediate stage of the crimping process.

When the dies 50, 50' (FIG. 11) move towards each other, they flex the beams 52, 52' towards each other until the outer ends of the beams touch, as shown in FIG. 11. The condition which is shown in FIG. 11 may be described as the touch point for the beams 52, 52' and the surfaces of the dies will be separated by the touch crimp height, the crimp height $H_0$. The dies 50, 50' are moved to a final crimp height H to establish the contact pressure at the ends of the beams. The following mathematical analysis is based on the conditions which exist in FIG. 12, that is, the point at which the dies have caused the ends of the cantilever beams to load each other.

Figure 12:
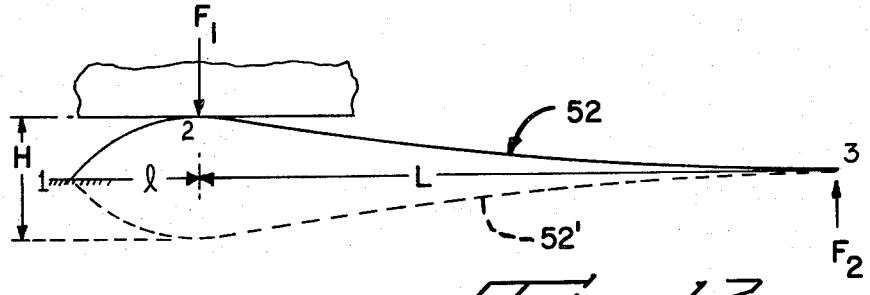
FIGS. 12 and 13 are diagrams referred to in the mathematical analysis.

For purposes of the following analysis, it is assumed that the connecting device comprises two cantilever beams, one of which is shown in FIG. 12 as a solid line and the other one of which is shown as a dotted line and is symmetrical to the solid beam in FIG. 12. The beam shown as a solid line in FIG. 12 is assumed to be fixed at 1, and the point of contact with the die 50 is indicated at 2, while the outer end of the beam 52 is indicated at 3. The cantilever beam 52 would be deflected under the combined loads of $F_1$ and $F_2$, $F_1$ being the load imposed by the crimping die 50, and $F_2$ being the reactive load imposed on the end of the beam by the other beam 52'.

The following bending moments are present in the cantilever beam shown in FIG. 12.

$$M_{12} = -F_1(y-L) + F_2 y \qquad \text{(I)}$$

$$M_{23} = F_2 y \qquad \text{(II)}$$

$M_{12}$ is the bending moment at any point along the section 1–2 of the beam, as a function of y, (the horizontal distance from point 3) and M23 is the bending moment at any point along the section 2–3 of the beam. These bending moments can be applied using Castigliano's theorum in the following integral form to calculate the effective elastic deflection δ which exists at the end of the beam (at 3 in FIG. 12).

$$\delta = \int_1^2 \frac{M_{12}\frac{\partial M_{12}}{\partial F_2}\,ds_{12}}{EI} + \int_2^3 \frac{M_{23}\frac{\partial M_{23}}{\delta F_2}\,ds_{23}}{EI} \qquad \text{III}$$

In this equation E, I and ds denote the elastic modulus, the moment of inertia, and element of path length.

Figure 13:
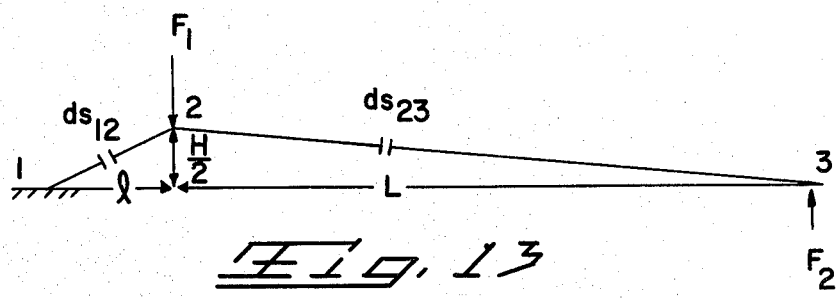

In order to simplify the calculations, it is assumed that the cantilever beam of FIG. 12 comprises two straight sections as an approximation as shown in FIG. 13. This approximation can be justified because of the fact that the arc along the length of the section 1–2 is relatively short and the section 2–3 is substantially straight to begin with; in other words, both sections (1–2 and 2–3) have a large radius of curvature relative to their lengths.

The integration of equation III produces the following equation:

$$\delta = \frac{F_2L^3}{3EI}\left\{\sqrt{1+\left(\frac{H}{2L}\right)^2} + \sqrt{1+\left(\frac{H}{2l}\right)^2}\left[\left(1+\frac{l}{L}\right)^3 - 1\right]\right\} - \frac{F_1L^3}{3EI}\sqrt{1+\left(\frac{H}{2l}\right)^2}\left\{\frac{1}{2} + \left(1+\frac{l}{L}\right)^2\left[\frac{l}{L}-\frac{1}{2}\right]\right\} \qquad \text{IV}$$

The factors under the square root signs appear because of the approximations made in FIG. 13 and reflect the fact that the beams are not perpendicular to the assumed applied loads $F_1$ and $F_2$.

If it is assumed that the cantilever beam 52 is fully yielded at 1 (a necessary condition), then $F_1$ can be expressed as follows:

$$F_1 = \frac{\sigma_t h t^2}{4l} + F_2\left(\frac{L+l}{l}\right) \qquad \text{V}$$

where l and L are shown in FIGS. 12 and 13, and $\sigma t$, t, and h are the tensile strength, material thickness of the beam 52, and the width of the beam, respectively.

In practical cases and for purposes of this discussion, the radius of curvature of section 1–2 of the beam 52 is only slightly changed from initial radius R when the connecting device is crimped to the extent shown in FIG. 12. If it is assumed that the radius of curvature of the section 1–2 is the same in FIG. 12, as it is in FIG. 10, then l can be eliminated as a variable by using the following equation which has been shown to be a good approximation experimentally.

$$\frac{H}{l} = \frac{\frac{H}{R}}{\sqrt{1 - \left(1 - \frac{H}{2R}\right)^2}} \qquad \text{VI}$$

Figure 14:
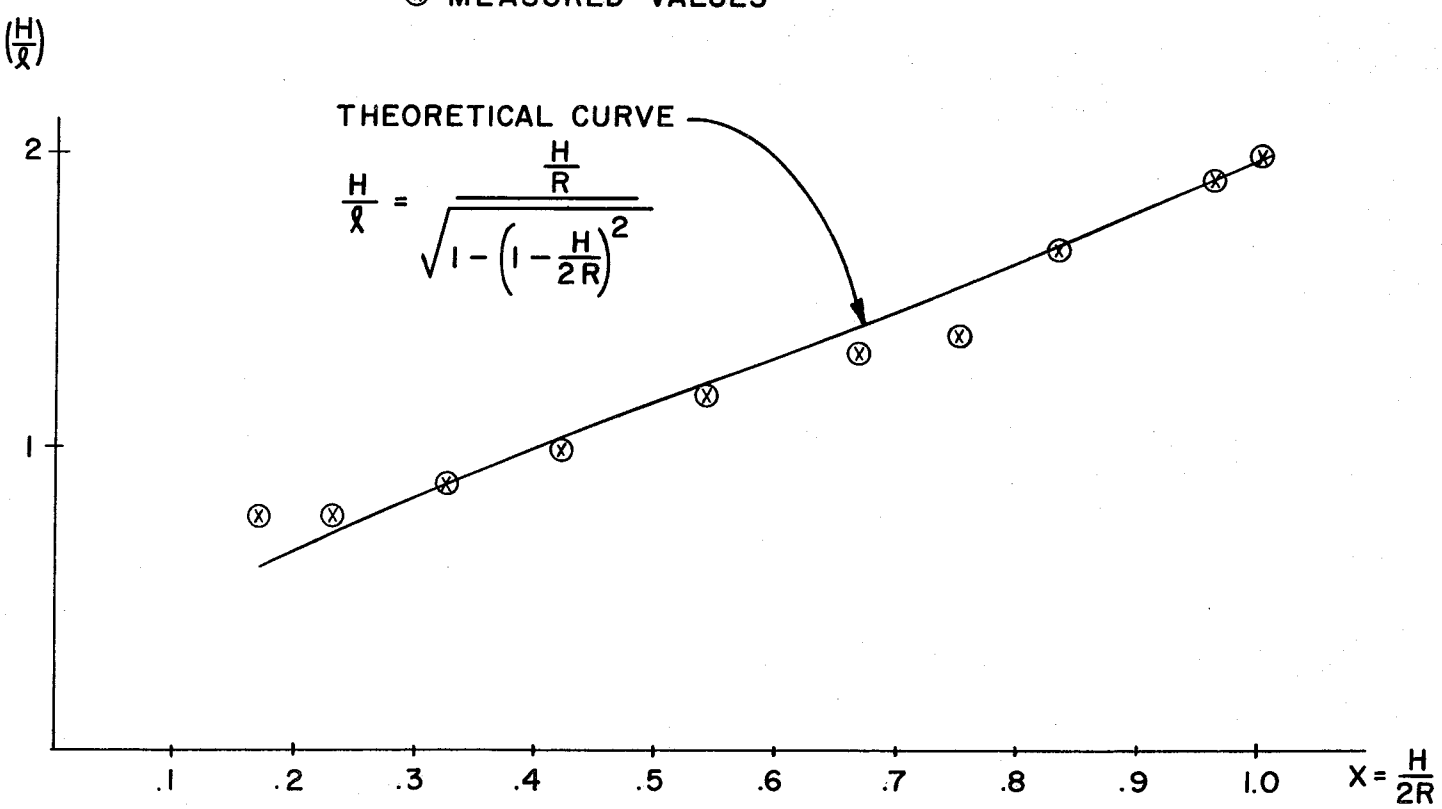
FIG. 14 is a curve referred to in the analysis.

Equation VI was derived by assuming that section 1–2 represents an arm having radius R which has been rotated about l in FIG. 12 due to the plastic hinge effect at 1. It should be noted that l defines the position where the crimping dies load the bight section. Thus, using equation VI enables us to account for the change in the loading position of the dies as a function of the final crimp height H. The loading position in FIGS. 11 and 12 is the point of contact of the die surface with the beam. This point moves leftwardly as the connecting device is crimped to the position of FIG. 12 and, during the final stages of the crimping process when the die is moved downwardly a short distance from the position of FIG. 12, the point of contact moves a further distance leftwardly. The verification of equation VI is shown in FIG. 14, in which the theoretical curve has been plotted over the observed data points shown as circles.

In addition to expressing H/2l as a function of H/2R, the relationship of equation VI can be used to express H/2L and l/L as functions of H/2R and g/R where g is defined in FIG. 10. The distance g was approximated by the following equation.

$$g \approx \sqrt{l^2 + \left(\frac{H}{2}\right)^2} + \sqrt{L^2 + \left(\frac{H}{2}\right)^2} \qquad \text{VII}$$

Figure 15:
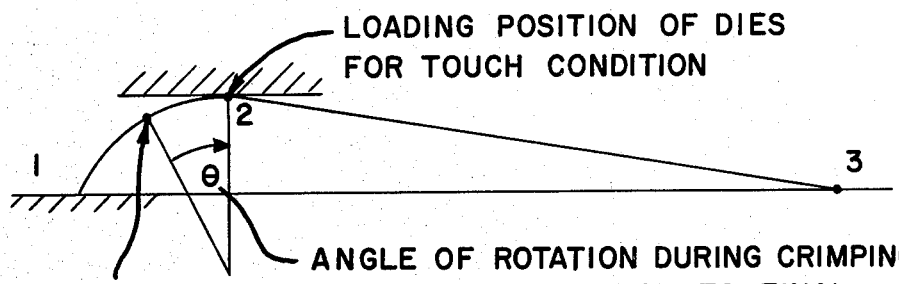
FIG. 15 is a further diagram used in the analysis.

Also, the expression for the elastic deflection of the single cantilever beam 2–3, which appears as the first term in equation IV, can be related to the radius R, and the crimp heights $H_0$ (the touch crimp height) and H (final crimp height). To do this we assume that the change in slope at the end of beam 2–3 can be calculated from the change in angle defined by the arc length from the touch point position of the dies to the position that the dies effectively move to in the final state (as seen in FIG. 15).

Thus we can derive the following relationship which is used to eliminate $F_2$ in the final equation.

$$F_2 \frac{L^2}{2EI} \sqrt{1 + \left(\frac{H}{2L}\right)^2} = \frac{\left\{\frac{(1-X)}{\sqrt{2X - X^2}} - \frac{(1-X_0)}{\sqrt{2X_0 - X_0^2}}\right\}}{\left\{1 + \frac{(1-X)(1-X_0)}{\sqrt{2X - X^2}\sqrt{2X_0 - X_0^2}}\right\}} \qquad \text{VIII}$$

In this equation, the expression $$\sqrt{1 + \left(\frac{H}{2L}\right)^2}$$

accounts for the fact that the beam 2–3 is not horizontal and $X_0$ equals $H_0/2R$ and X equals H/2R are expressions containing the touch crimp height and final crimp heights $H_0$ and H, respectively.

These substitutions eliminate all variables except the given variable which is H/2R, and touch crimp height $H_0/2R$, the parameter P, which equals $Et/\sigma_t R$ and g/R where g is given in FIG. 10, $\sigma_t$ being the tensile strength, as noted above. At this stage, all variables have been defined except $X_0$, which is equal to $H_0/2R$ and the final form of equation IV becomes:

$$\frac{\delta}{R} = \left(\frac{2}{3}\ \frac{X}{X_2}\right) \frac{\left\{\frac{(1-X)}{\sqrt{2X - X^2}} - \frac{(1-X_0)}{\sqrt{2X_0 - X_0^2}}\right\}}{\left\{1 + \frac{(1-X)(1-X_0)}{\sqrt{2X - X^2}\sqrt{2X_0 - X_0^2}}\right\}} \left\{1 + \frac{\sqrt{1 + X_1^2}}{\sqrt{1 + X_2^2}} [(1 + X_3)^3 - 1]\right\} -$$

$$\left[\frac{2}{3}\ \frac{X}{X_2}\ \frac{\left\{\frac{\frac{(1-X)}{\sqrt{2X - X^2}} - \frac{(1-X_0)}{\sqrt{2X_0 - X_0^2}}}{1 + \frac{(1-X)(1-X_0)}{\sqrt{2X - X^2}\sqrt{2X_0 - X_0^2}}}\right\}}{X_3\sqrt{1 + X_2^2}} (1 + X_3) + \frac{1}{PX_3X_4^2}\right] \sqrt{1 + X_1^2} \left\{\frac{1}{2} + (1 + X_3)^2 \left(X_3 - \frac{1}{2}\right)\right\}$$

where $X = \frac{H}{2R}$ $X_0$ = TOUCH VALUE OF $X$ (FIG. II)

$$X_1 = \frac{X}{\sqrt{1 - (1 - X)^2}}$$

$$X_2 = \frac{X}{\sqrt{\left(\frac{g}{R} - \sqrt{2X}\right)^2 - X^2}}$$

$$X_3 = \frac{X_2}{X_1}$$

-continued $$X_4 = \frac{1}{\sqrt{\left(\frac{g_1}{R} - \sqrt{2X}\right)^2 - X^2}}$$

$$P = \left(\frac{Et}{\sigma_t R}\right)$$

Equation IX enables us to calculate the effective elastic deflection at 3 in FIG. 12. Since in these calculations the direction of $F_2$ has been chosen as positive with regard to deflection, a positive value for $\delta/R$ indicates a pre-loaded condition exists. On the other hand, a negative value for $\delta/R$ indicates no pre-load will remain after the device is removed from the crimping dies; in other words, the opposing beams 52, 52' will spring away from each other.

Figure 16:
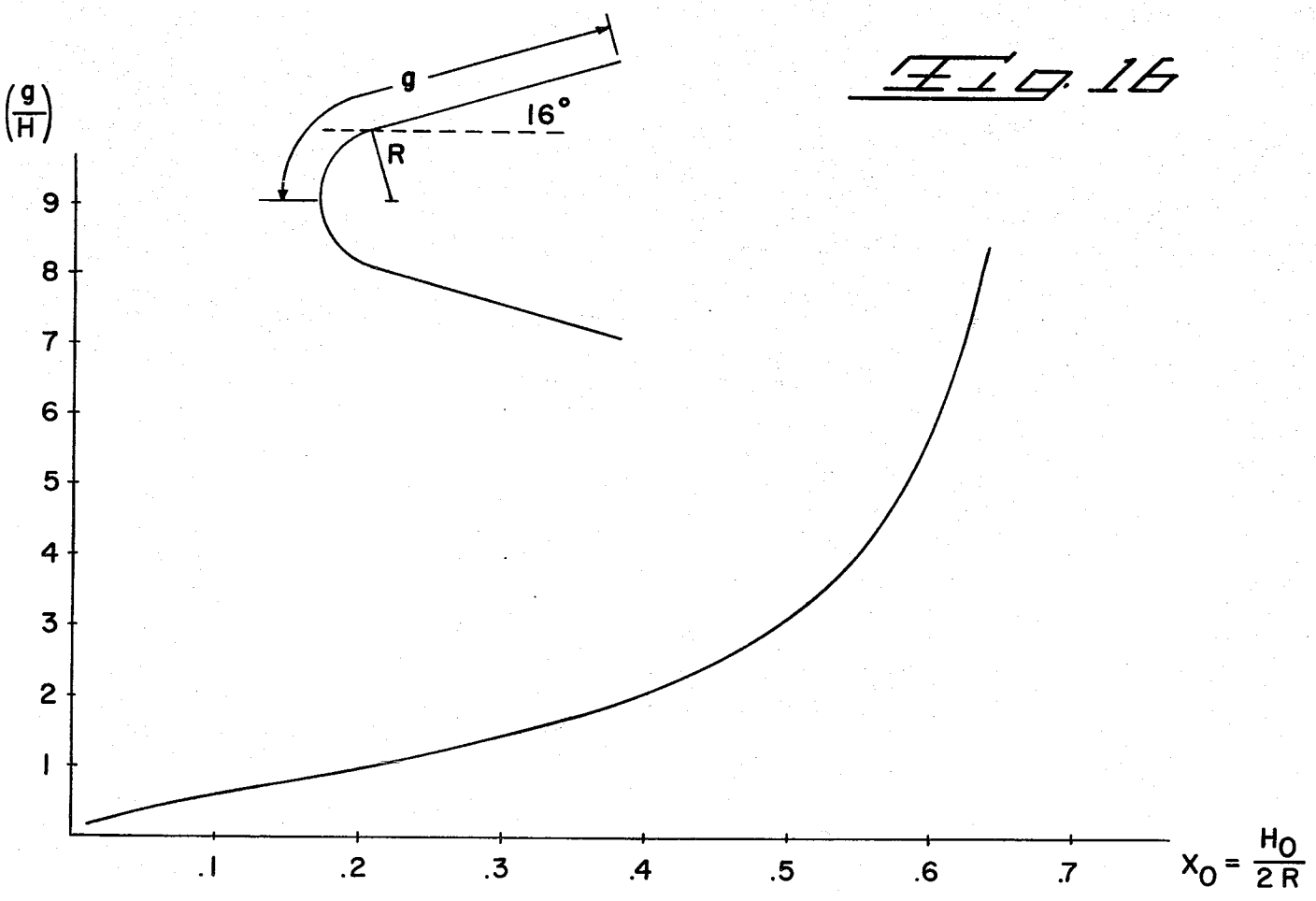
FIGS. 16 and 17 are additional curves used in the analysis.

FIG. 16 is a geometrical relationship and shows g/R as a function of $X_0$. This relationship is obtained using the same assumptions that led to the derivation of equation VI.

Figure 17:
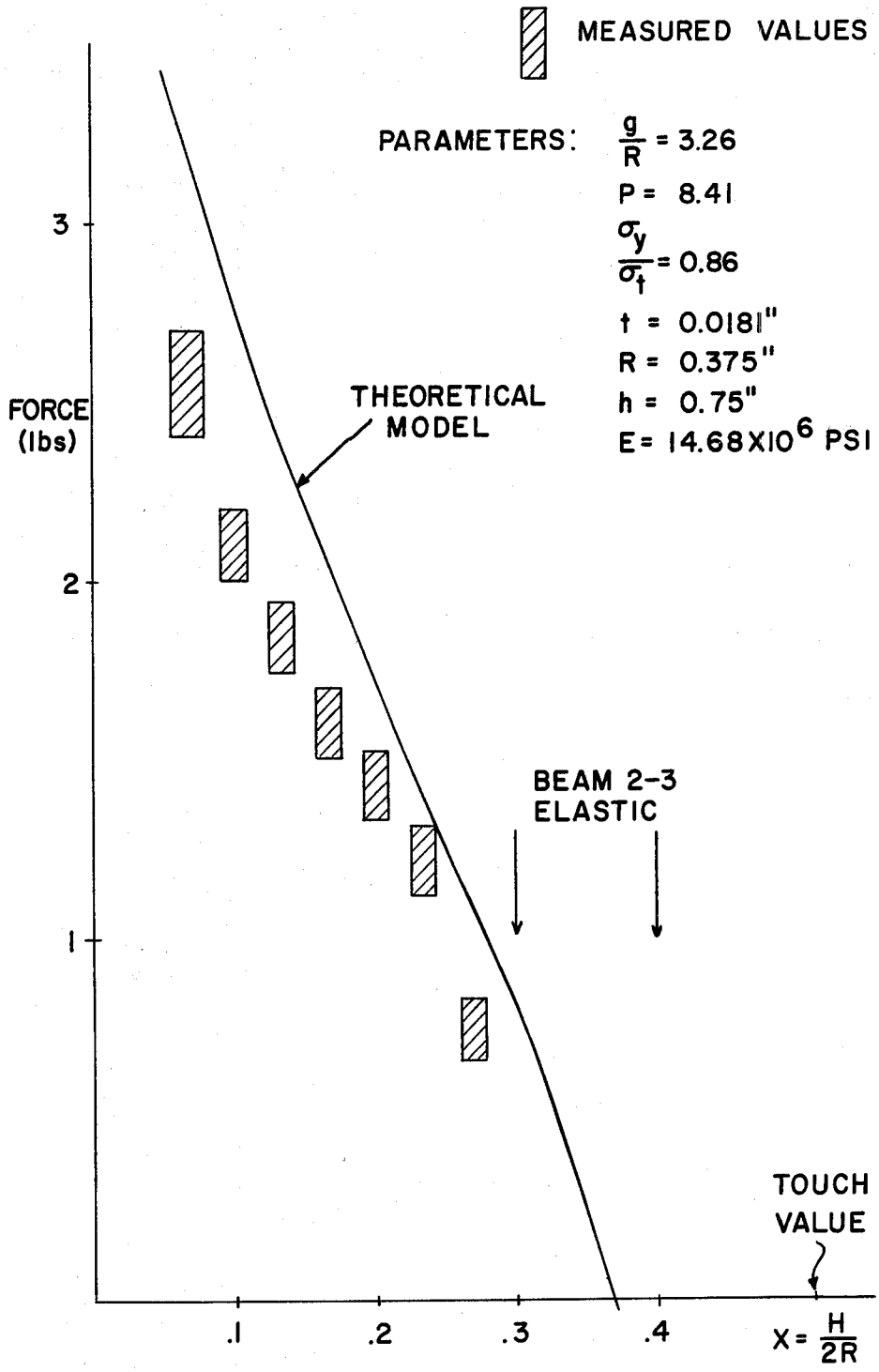

If a given geometry for the connecting device is chosen, g/R would be known from its dimension and $X_0$ can be obtained from FIG. 16. For a given material, stock thickness t and radius R, the parameter P can be calculated and the ratio of deflection to radius, as a function of X, could then be calculated from equation IX. The deflection as determined from equation IX can then be used as a basis for calculating the contact force at the end of the beam after removal of the crimped device from between the dies. The contact force can then be plotted if desired, as a function of X, and as shown in FIG. 17. FIG. 17 compares the calculated pre-load (solid line) to the values measured for the example given in FIGS. 16 and 17.

To carry out the calculations for the example given in FIG. 17, equation VIII is used to provide data on the elastic deflection of the beam section 2–3. This beam section is elastically deflected during the initial stages of crimping but it becomes partially plastically deformed when it is crimped past the 0.3 value for X, as seen in FIG. 17. Although the beam 2–3 is plastically deformed during the final stages of the crimping, the force $F_2$ can be related to the elastic springback in the plastically deformed beam and thus can be associated with the elastic deflection that remains in beam section 2–3.

An estimate can be made of the value of X at which beam 2–3 begins to plastically deform by replacing $F_2$ in equation VIII, with the value that defines the beginning of yield at the point of loading, 2, as follows:

$$F_2 = \frac{\sigma_y h t^2}{6L} \qquad \text{X}$$

where $\sigma y$ is the yield strength and h and t are defined above. This equation defines the yield condition for a beam of rectangular cross section having a thickness t and a width h and subjected to a bending moment $F_2L$.

An upper limit can be placed on $F_2$ using the fully yielded condition for the section at 2 with the following equation:

$$F_2 = \frac{\sigma_t h t^2}{4L} \qquad \text{XI}$$

where $\sigma t$ is the tensile strength. Equations X and XI define the range over which $F_2$ changes as we further crimp the device past the X=0.3 value. Thus, by modeling elastic/plastic behavior of the beam over this range of forces, we can estimate the change in elastic deflection of beam 2–3 as a result of a change in $F_2$ as crimping continues to final crimp height. This was done for the present example by using equations X and XI as constraints on $F_2$. The following approximate equation was obtained to estimate the elastic deflection in beam 2–3 during plastic deformation.

$$\frac{F_2L^3\sqrt{1+\left(\frac{H}{2L}\right)^2}}{3EI\,R} = \frac{2}{3}\left(\frac{1}{P}\right)\left(\frac{X}{X_2}\right)^2\left\{\frac{\sigma_y}{\sigma_t} + \left(\frac{\sigma_t - \sigma_y}{\sigma_t}\right)\frac{(X_y - X)}{X_y}\right\}\left\{1 + \frac{0.5(X_y - X)}{X_y}\right\} \qquad \text{XII}$$

In this equation, the first quantity in curly brackets represent a linear increase in work hardening as crimping proceeds and the second quantity in curly brackets represent a linear increase towards the fully yielded condition. Here $X_y$ is the value of X when beam section 2–3 begins yielding at 2.

To summarize, a model has been provided which permits calculation of the effective elastic deflection at 3 in FIG. 12 by using either equation VIII for elastic conditions in beam section 2–3 or equation XII for elastic/plastic conditions in the same beam section. From the knowledge of the effective elastic deflection at 3 in FIG. 12, the final contact force which subsists after removal of the crimped connecting device from between the dies can be calculated with equation XIII. As mentioned above, the effective deflection at 3 could be positive or negative. When the calculations show that the elastic deflection is positive at 3, then the condition for an effective crimped connection is met and the amount of deflection at 3 is unchanged when the connecting device is removed from between the dies. It is this deflection at 3 which is used to calculate the contact force in the crimped connection, as mentioned above.

$$F = \left\{ \frac{\frac{Eht}{4}\left(\frac{t}{R}\right)^2\left(\frac{X_2}{X}\right)^3}{\sqrt{1+X_2^2}+\sqrt{1+X_1^2}\left[\left(\frac{X_2}{X_1}+1\right)^3-1\right]} \right\}\left(\frac{\delta}{R}\right) \quad \text{XIII}$$

All of the terms in equation XIII have been defined previously. Equation XIII relates the force to the deflection of a cantilever beam as shown in FIG. 13 but with the force $F_1$ of FIG. 13 removed.

The solid line curve of FIG. 17 which represents the theoretical model analyzed above, is in reasonably good agreement with the observed data points shown on this figure. It can therefore be concluded that the theoretical curve can be used to estimate important characteristics of the crimped connection and the effect of crimp height on these characteristics. For example, the theoretical curve shows that when the crimping dies are moved towards each other and the connecting device is crimped only to the extent that the outer ends of the beams touch each other, where X is 0.51, the ends of the arms will spring apart after the connecting device is removed from between the dies. It is necessary that the connecting device be crimped to an X value of 0.37 before the condition of pre-loading is achieved, that is, before the arms will remain against each other when the connecting device is removed from between the dies. As a practical matter, the connecting device will ordinarily be crimped to an X value which is significantly less than 0.37 and the precise X value of the finished crimped connection will produce predictable force in the beams which can be determined from FIG. 17. Thus, if the connecting device is crimped to an X value of 0.2, the beams will exert a contact force of about 1.7 pounds.

The theoretical curve shown in FIG. 17 is valid only for the material constants and dimensions which were assumed in the mathematical model discussed above and if different constants were used in the mathematical analysis, a different curve would be obtained. For any assumed set of constants then, a curve of the type shown in FIG. 17 can be plotted and from this curve, the behavior of the crimped connection can be predicted. Curves of this type are thus capable of serving as a valuable design tool and their use will avoid time-consuming and wasteful experimentation in determining dimensions and material constants for a crimped connection in accordance with the invention.

Crimped connections for conductors on thin films, in accordance with the invention, have several advantages over previously available crimped connections and over the commonly used soldering techniques. Soldering to conductors on thin films is frequently sensitive to the nature of the conductor and soldering to some types of electrodeposited conductors can be carried out only with great difficulty and with unsatisfactory reliability. A crimped connection in accordance with the present invention does not depend upon, and is not affected by, the nature of the conductor.

As mentioned previously, the principal crimping forces are applied to the bight portion of the connecting device, rather than to the cantilever beams. These forces may be quite high but no damage will be caused to the conductors on the film, since the high crimping forces are transmitted through the bight section rather than through the beams and the only forces developed in the beams are the contact forces or forces slightly in excess of the contact forces.

The crimped connection, in accordance with the invention, has relatively limited thickness as is apparent from FIG. 6, and it is not therefore grossly larger than the film on which it is made. Additionally, the width of the connecting device can be restricted, as compared with previously available crimped connections, and under many circumstances the connecting device need be no wider than the conductor on the film.

The disclosed embodiment has a single contact post 16 which may be mated with a complementary connecting device or inserted through a hole in a circuit board and soldered to a conductor on the circuit board. Other types of terminal devices can be provided on the connecting device 8 as required. It is also practical to eliminate the terminal post 16 and to mate the crimped connecting device 32 directly with a complementary connecting device which may be contained in an insulating housing.

Connecting devices 8, in accordance with the invention, can be produced as a continuous strip 48 (FIG. 8) comprising a carrier strip 46 which is integral with the ends of the beams 12. A strip of connecting devices, as shown in FIG. 8, can be crimped onto the conductors 42 of a multi-conductor cable 40 by locating the end 44 of the cable between the opposed surfaces 1 of the beams, simultaneously crimping all of the connecting devices onto the individual conductors 42, and severing the carrier strip 46 from the ends of the beams 12. This mass crimping process can be carried out by means of crimping dies of the type shown at 22, 22' in FIG. 2.

Under some circumstances it may be desirable to provide projections on the opposed surfaces 13, 15 of the cantilever beams for the purpose of penetrating any thin oxide film which may be formed on the conductors. Also, the opposed surfaces may be provided with barbs for the purpose of penetrating insulation when connecting devices in accordance with the invention are used for establishing contact with the conductors of a flat conductor cable. The use of barbs or other projections is also beneficial in that the film and crimped connecting device will resist movement relative to each other. If such projections are provided, the contact force would nonetheless be maintained by the stressed condition of the cantilever beams.

We claim:

1. A crimped electrical connection between a stamped and formed metallic connecting device and a flat conductor, said crimped electrical connection being characterized in that:

said connecting device comprises a pair of opposed cantilever beams connected by an arcuate bight section, said conductor being between said beams with portions of said beams being against said conductor, said beams being in a preloaded and flexed condition against said conductor, portions of said bight section being severely plastically deformed and serving to maintain said beams in said preloaded and flexed condition against said conductor whereby, said one beam is resiliently biased against, and maintained in electrical contact with, said conductor, the preloaded and flexed condition of said beams and the function of said bight section in maintaining said beams in said preloaded and flexed condition being the sole means serving to maintain said beams against said conductor.

2. A crimped electrical connection between a stamped and formed metallic connecting device and a conductor on an insulating substrate such as an insulating film, said conductor extending to one edge of said substrate, said crimped electrical connection being characterized in that:

said connecting device comprises a pair of opposed cantilever beams connected by an arcuate bight section, said substrate being between said beams with one of said beams being against said conductor, said beams being in a preloaded and flexed condition against said substrate, portions of said bight section being severely plastically deformed and serving to maintain said beams in said flexed condition and against said substrate whereby, said one beam is resiliently biased against, and maintained in electrical contact with said conductor, the preloaded and flexed condition of said beams and the function of said bight section in maintaining said beams in said preloaded and flexed condition being the sole means serving to maintain said one beam in contact with said conductor.

3. A crimped electrical connection as set forth in claim 2, said crimped connection having been produced by forming a metal strip into a U-shape having a bight of initial radius of curvature R and having said cantilever beams extending from said bight, positioning said substrate between said beams, positioning said connecting device between opposed parallel die surfaces of crimping dies, moving said dies towards each other until the ends of said cantilever beams touch and said bight is against said die surfaces, and thereafter moving said dies towards each other and reducing said radius R by plastic deformation of portions of said bight section with accompanying flexing of said beams against said substrate.

4. A crimped electrical connection as set forth in claim 2, said connecting device having an integral terminal portion extending therefrom.

5. A crimped electrical connection as set forth in claim 4, said terminal portion comprising a terminal pin extending laterally from one of said cantilever beams.

6. A method of establishing an electrical connection to a conductor on a substrate such as an insulating film, said conductor extending to one edge of said substrate, said method comprising the steps of:

forming an elongated strip of conductive metal into a U-shaped connecting device having a bight and cantilever beams extending from said bight, positioning said film between said cantilever beams with said conductor in alignment with one of said beams, positioning said connecting device between opposed parallel surfaces of crimping dies, moving said dies normally of said parallel surfaces towards each other until the ends of said beams touch and said surfaces are against said bight on opposite sides thereof, and further moving said surfaces towards each other and reducing the radius of curvature of the root portion of said bight, with accompanying plastic deformation of portions of said bight and the development of bending stresses in said beams whereby, upon removal of said connecting device from between said surfaces, said beams are held in a preloaded and flexed condition against said substrate by said bight and one of said beams is held against said conductor, the preloaded and flexed condition of said beams and the function of said bight in maintaining said beams in said preloaded and flexed condition being the sole means serving to maintain said one beam in contact with said conductor.

7. A method of establishing electrical connections with a plurality of conductors on a substrate such as on insulating film, said conductors extending to one edge of said substrate and being in parallel spaced-apart relationship at said edge, said method comprising the steps of:

providing an elongated strip of connecting devices, said strip comprising a continuous carrier strip, said connecting devices being integral with said carrier strip at spaced-apart intervals corresponding to the distance between said conductors on said substrate, each of said connecting devices being generally U-shaped and having a bight and cantilever beams extending from said bight, positioning said substrate between said beams with said one edge proximate to said bight and with said beams in alignment with said conductors, positioning said connecting devices between opposed parallel die surfaces of crimping dies, moving said dies normally of said parallel die surfaces towards each other until the ends of said beams of said connecting devices touch the surfaces of said substrate, further moving said die surfaces towards each other and reducing the radius of curvature of the root portions of the bights of said connecting devices with accompanying plastic deformation of portions of said bights and the development of bending stresses in said cantilever beams of said devices, and severing said carrier strip from said connecting devices whereby, each of said connecting devices will be crimped onto one of said conductors with one of said beams of each connecting device resiliently preloaded and biased against its respective conductor, the preloaded and biased condition of said beams and the function of said bights in maintaining said beams in said preloaded and biased condition being the sole means serving to maintain said beams against said film and against said conductors.

* * * * *